US010800590B2

(12) United States Patent
Folatelli

(10) Patent No.: US 10,800,590 B2
(45) Date of Patent: Oct. 13, 2020

(54) ARRANGEMENT FOR RAPID PREPARATION OF PRODUCTS THAT CAN BE ENCAPSULATED

(71) Applicant: Patricio Dardo Folatelli, Provincia de Buenos Aires (AR)

(72) Inventor: Patricio Dardo Folatelli, Provincia de Buenos Aires (AR)

( * ) Notice: Subject to any disclaimer, the term of this patent is extended or adjusted under 35 U.S.C. 154(b) by 91 days.

(21) Appl. No.: 14/787,008

(22) PCT Filed: Apr. 23, 2014

(86) PCT No.: PCT/IB2014/060938
§ 371 (c)(1),
(2) Date: Oct. 26, 2015

(87) PCT Pub. No.: WO2014/174459
PCT Pub. Date: Oct. 30, 2014

(65) Prior Publication Data

US 2016/0075497 A1 Mar. 17, 2016

(30) Foreign Application Priority Data

Apr. 26, 2013 (AR) ..... 20130101425

(51) Int. Cl.
*B65D 85/816* (2006.01)
*B65D 81/32* (2006.01)

(52) U.S. Cl.
CPC ..... *B65D 81/3205* (2013.01); *B65D 81/3211* (2013.01); *B65D 85/816* (2013.01)

(58) Field of Classification Search
CPC .. B65D 85/816; B65D 81/32; B65D 81/3211; A47J 43/27

(Continued)

(56) References Cited

U.S. PATENT DOCUMENTS

2009/0092711 A1 4/2009 Ninh
2009/0184080 A1 * 7/2009 Klaver ..... A61J 9/00 215/6

(Continued)

FOREIGN PATENT DOCUMENTS

DE 102007017464 7/2008
FR 2926794 A1 * 7/2009 ..... B65D 85/816
WO WO2014068093 5/2014

OTHER PUBLICATIONS

FR_2926794_translation.pdf.*
Hex_reducer_pipe_bushing.pdf Hex Reducer Pipe Bushing Dec. 29, 2011.*

*Primary Examiner* — Allan D Stevens
(74) *Attorney, Agent, or Firm* — Defillo & Associates Inc.; Evelyn A. Defillo

(57) ABSTRACT

An arrangement for the rapid preparation of various products that can be encapsulated includes: a capsule (10) which contains a concentrated dose or an exact measurement of a given product to be diluted (a) and a container (20) for receiving an amount of a given dilution product (b). The capsule (10) is a disposable element having an outlet (11) provided with detachable closure elements (12). The container (20) having a lower opening (21) with a reciprocal connection device (22) capable of forming a firm airtight bond with the opening (11) of the capsule (10) and an top opening (23) adapted for receiving the dilution product (b) and dispensing the mixture (c) including the metered dose (a) of the dilution product (b).

1 Claim, 3 Drawing Sheets

(58) Field of Classification Search
USPC ..... 426/86, 77; 215/DIG. 8; 206/219, 221, 206/222
See application file for complete search history.

(56) References Cited

U.S. PATENT DOCUMENTS

| | | | | |
|---|---|---|---|---|
| 2009/0311389 | A1* | 12/2009 | Zoss | B65D 51/247 426/120 |
| 2010/0163439 | A1* | 7/2010 | Gutierrez Avendano | B65D 81/3211 206/219 |
| 2010/0213085 | A1* | 8/2010 | Belnap | A61J 1/2093 206/219 |
| 2013/0119056 | A1* | 5/2013 | Jacobson | A45F 3/18 220/4.01 |

* cited by examiner

ARRANGEMENT FOR RAPID PREPARATION OF PRODUCTS THAT CAN BE ENCAPSULATED

CROSS REFERENCE TO RELATED APPLICATION

This application is a national stage entry of PCT/IB2014/060938 filed Apr. 23, 2014, under the International Convention claiming priority over Argentinean Patent Application No. 20130101425 filed Apr. 26, 2013.

FIELD OF THE INVENTION

The present invention relates to a novel arrangement for the rapid preparation of products that can be encapsulated, in particular products supplied as liquids, slurries or pastes. The object of the present invention is to obtain different kinds of products comprising a concentrated dose or an exact measurement of a given product and a product which is a dilution of the first product, in the composition.

SUMMARY OF THE INVENTION

The proposed constructive arrangement solves the problem of the exact calculation of the proportion of what will be added to another concentrated product or product which must be diluted. it also simplifies the preparation of some products in which the recipe, the proportions and the necessary ingredients must be known.

Essentially, the object of the present invention comprises, in combination, a capsule which contains the concentrated dose or accurate measurement of a given product and a dispensing container which contains a second given product in which the first product must be diluted. The dispensing container is provided with a first opening adapted to connect with the capsule and a second opening provided with the necessary means to output the processed product.

The present arrangement allows the finished product to be obtained in an economic, practical and simple form, with a high level of reliability of its correct formulation.

The product contained in the capsule can be natural, concentrated or frozen.

The proposed arrangement is used in various fields, namely:

in the food field, for the preparation of: alcoholic cocktails, fruit concentrates for cocktails, fruits, energy drinks, hot and cold drinks, beer, fruit juices, soups, milks and milk products, beverages in general such as "ready to drink".

In the health field the new arrangement may be used for the preparation of: food supplements, mineral salts integrator, generally integrators, soluble drug and generally soluble products.

In the cleaning field, for the preparation of cleaning agents and detergents, among others.

The dispensing container may have any shape suitable to the product for application in the various fields mentioned, such as in the shape of a plate, cup, bowl, whisk or bowl, in the case of the preparation of ready to drink beverages; in the shape of a baby bottle with the corresponding teat in the case of milk with concentrated additives; and in the shape a bottle-type container with a spray nozzle for the preparation of cleaning products.

Other features and advantages of the invention will be explained in the following description.

BRIEF DESCRIPTION OF THE DRAWINGS

Considering the above and other related purposes, the invention comprises the construction details and combination of parts as will be understood based on the following description with reference to the accompanying drawings in which.

In these figures the same reference numerals indicate like or corresponding parts.

Figure 1:
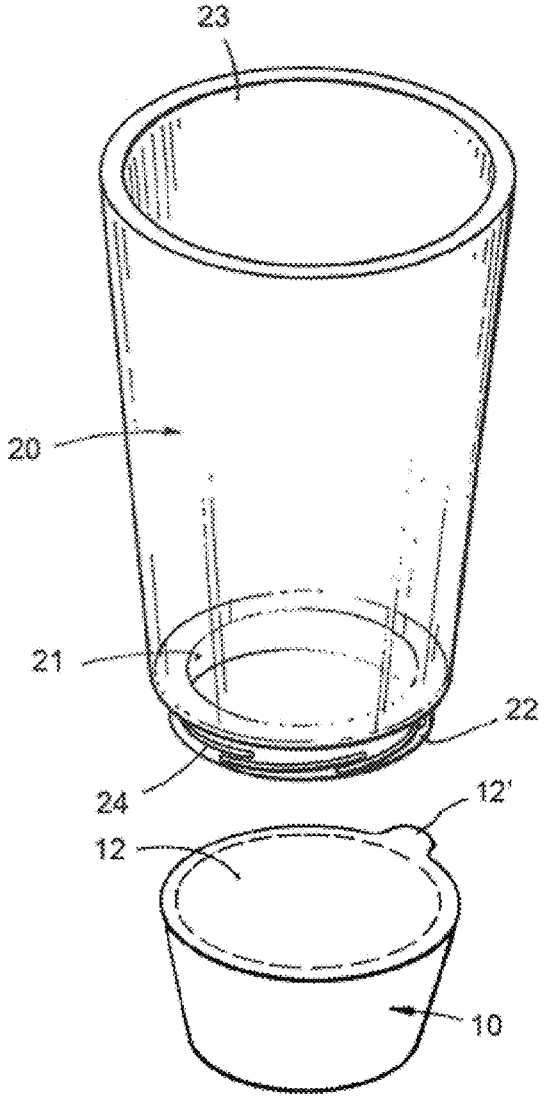
FIG. 1 is a perspective view of an embodiment of the present invention, which comprises a capsule containing a measured product and a dispensing container, showing said separate elements, wherein the capsule is shown closed and wherein the dispensing container is a cup.
Figure 2:
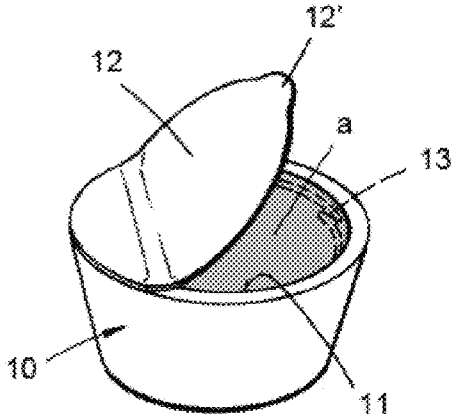
FIG. 2 is another perspective view only of the capsule containing a measured product, showing the opening of said capsule, with the closing element in a partly detached position.

LIST OF KEY REFERENCES (a) Concentrated and measured product.
(b) Dilution product.
(c) Finished product comprised by the mixture of concentrated and measured product (a) and dilution product (b).
(d) Ice cubes.
(e) Mixing palette
(10) Capsule containing concentrated and measured product (a).
(11) Discharge opening of capsule (10).
(12) Detachable cover of the discharge opening (11).
(12') Flange for the detachable cover (12).
(13) internal threads of the discharge opening of capsule (10).
(20) Dispensing container.
(21) Bottom opening of the dispensing container (20).
(22) Lower rim of the dispensing container (20) of connection with the discharge opening of capsule (10).
(23) Top opening of the dispensing container (20).
(24) Half thread type fastening device of the dispensing container (20).
(25) Annular sealing element (O-ring).
(30) Adapter for connection between different capsules (10) and various dispensing containers
(31) Body in the shape of a tube segment of the adapter (30).
(32) Faceted flange for joining of the adapter (30).
(33) male threaded locking element of the adapter (30).
(34) female threaded locking element of the adapter (30).

MAIN OBJECT

For the specified purpose, an arrangement is provided for the rapid preparation of products that can be encapsulated characterized in that it comprises in combination a capsule (10) which contains a concentrated dose or exact measure to be diluted of the concentrated and measured product (a) and a container (20) suitable for receiving an amount of a given dilution product (b), wherein said capsule (10) has a discharge opening (11) provided with detachable cover (12), and wherein said dispensing container (20) has a bottom opening (21) and a lower rim (22) capable of forming a firm airtight bond with the discharge opening (11) of the capsule (10) and a top opening (23) adapted for receiving the dilution product (b) and dispensing the finished product (c) comprising said concentrated and measured product (a) and the dilution product (b).

DETAILED DESCRIPTION OF THE PREFERRED EMBODIMENT

The present invention includes an arrangement for the rapid preparation of products that can be encapsulated, including of a capsule (10) which contains a concentrated and measured product (a) of a finished product (c) to be prepared, and an "ad hoc" dispensing container (20) with a connecting device to connect to the capsule (10). The dispensing container (20) is a container of another part of the dilution product (b) in which the concentrated part of the concentrated and measured product (a) is diluted.

In the embodiment chosen for illustrating the present invention, the concentrated and measured product (a) is a liquid concentrate of an alcoholic beverage, the dilution product (b) is a carbonated beverage which is incorporated in the dispensing container (20), which is a glass.

Always according to this example and without limitation, the dispensing container (20) has a bottom opening (21) with a lower rim (22) with half thread type fastening device (24) comprising an arrangement of consecutive segmented ribs that form a component part of quick coupling type referred to as "half thread".

At the top end of the dispensing container (20) is formed the top opening (23) of the dispensing container.

In the present example and without limitation, the capsule (10) is a bowl containing the concentrated and measured product (a) is a liquid or powder concentrate designed to form the bottom of the glass, with a discharge opening (11) having an array internal threads (13) cooperating with the half thread type fastening device (24) of the dispensing container to form a quick coupling between the two parts for assembly. Preferably said joint is sealed with an O-ring (25) to ensure the closure is airtight.

Each capsule (10) is provided with a dosage of the concentrated and measured product (a) and the discharge opening (11) of the capsule has a a detachable cover (12) sealed along the perimeter and provided with a flange (12') for extraction.

The invention provides an adapter (30) to join different capsules (10) with different dispensing containers (20).

Figure 6:
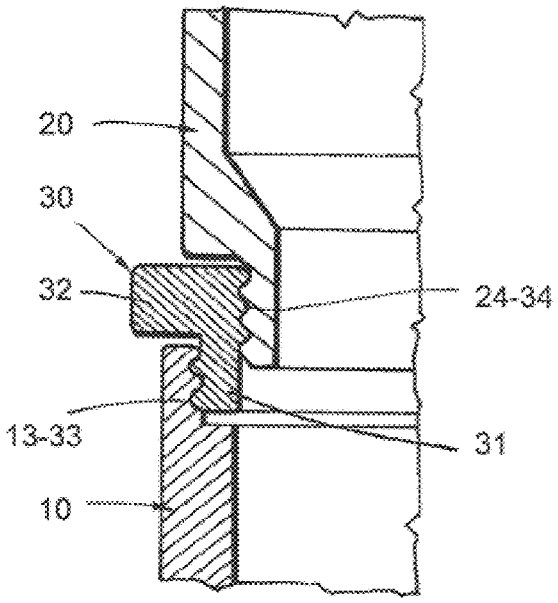
FIG. 6 is a partial sectional view showing the joint between the capsule and the corresponding dispensing container with the insertion of the adapter according to the embodiment of FIG. 5.

In the preferred embodiment, the adapter (30) comprises a body (31) in the shape of a tube segment of low height, which has a faceted flange (32) for gripping during the joining with the capsule (10) and the dispensing container (20). The body (31) has a male threaded locking element (33) which form a quick coupling type referred to as "half thread", cooperating with internal threads (13) provided in the opening of the capsule (FIG. 6), also in the opposite end, said body (31) having female threaded locking elements (34) cooperating with the half thread type fastening device (24) of the bottom of the container.

Figure 3:
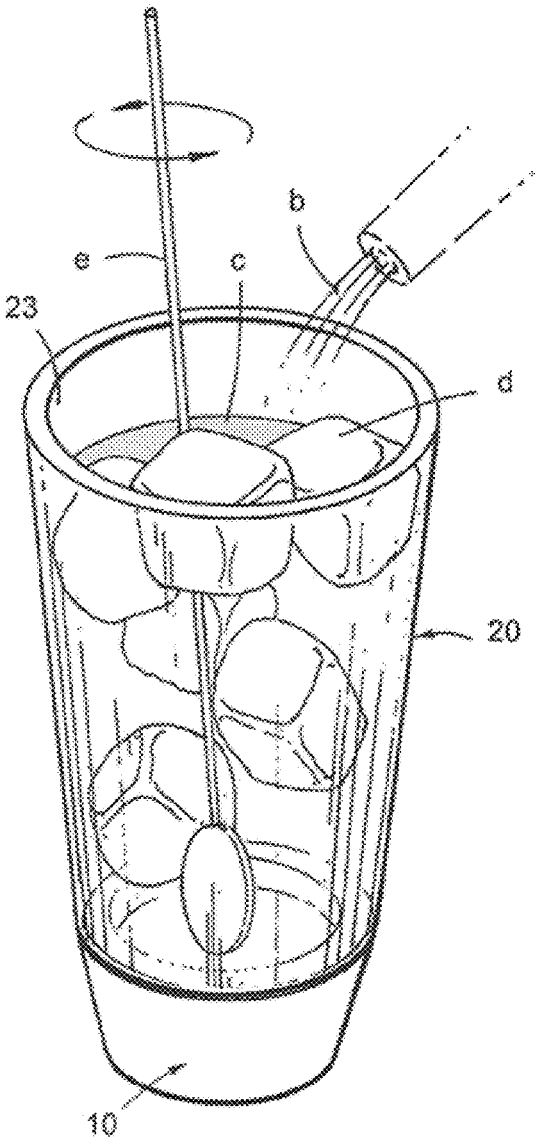
FIG. 3 is another perspective view of the embodiment according to FIG. 1 showing the assembled capsule and dispensing container in a position of use, and showing the preparation of the finished product obtained by adding and mixing the dilution product and ice cubes in the container.
Figure 4:
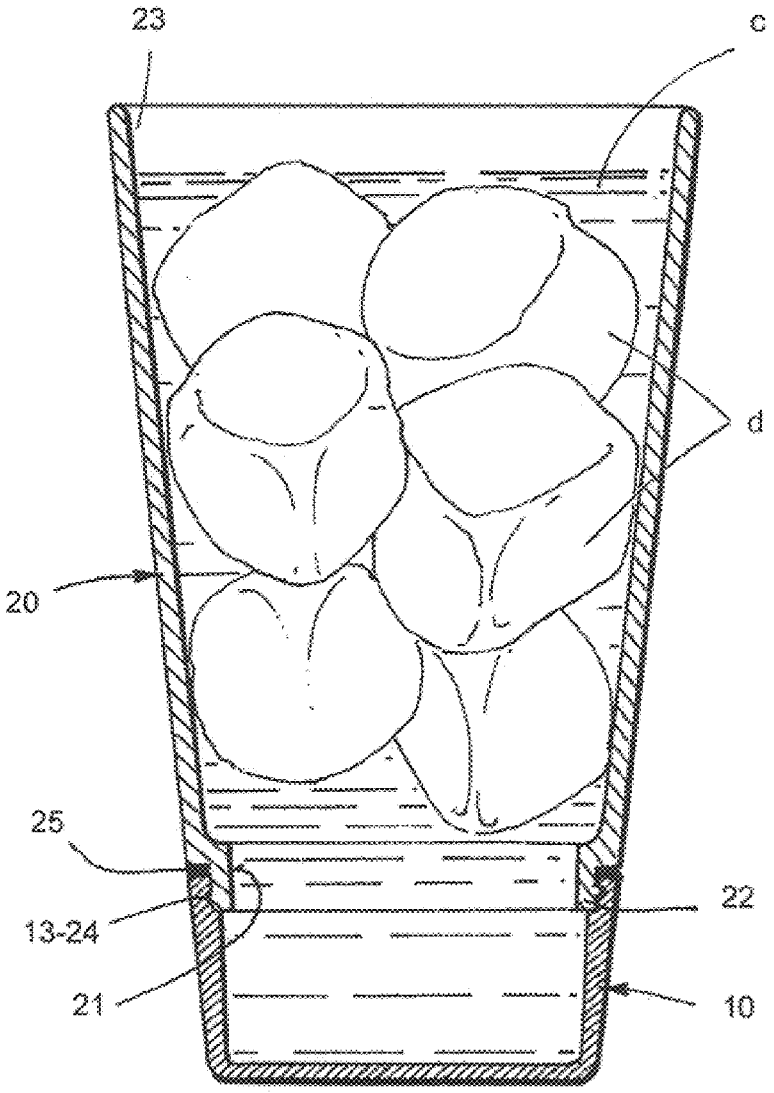
FIG. 4 is a longitudinal sectional view according to FIG. 3, showing the product already mixed and ready for consumption.
Figure 5:
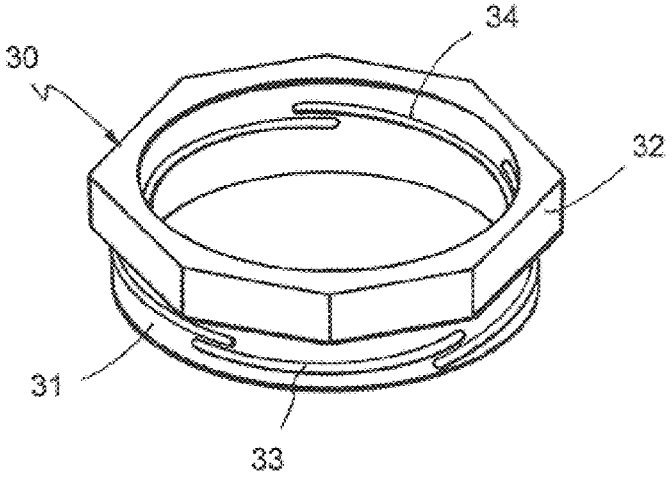
FIG. 5 is a perspective view of an adapter part for connection between different capsules and corresponding dispensing containers.

In the proposed example, particularly with reference to FIGS. 3 and 4, once the detachable cover (12) is removed, the capsule (10) is fixed on to the lower end of the dispensing container (20), exposing the concentrated and measured product (a) at the bottom of the vessel through the bottom opening (21). In this situation, the dilution product (b) and other additives, for instance ice cubes (d) can be introduced through the opening of the container. The content is manually stirred with a suitable element such as the mixing palette (e), to mix the concentrated and measured product (a) and the dilution product (b) to obtain the ready to drink finished product (c).

The invention claimed is:

1. An arrangement for the rapid preparation of an alcoholic beverage consisting of:

a capsule including a measured amount of an alcoholic beverage, the capsule includes an open top end having internal threads;

a container, the container having an open bottom end from which protrudes a lower rim having external threads; and an adapter to connect the capsule to the container, the adapter consisting of:

a body having a first end, a second end, and a central section having a constant inner diameter located between the first end and the second end;

external threads on an external side of the central section, the external threads connect with the internal threads of the capsule;

a faceted flange projecting away from the first end of the body; and internal threads to connect with the external threads of the lower rim of the container;

wherein a measured amount of a dilution product is capable of being poured into the container by a user and then mixed with the measured amount of the alcoholic beverage, when the adapted is threadably engaged with the container and the capsule; and wherein the capsule and the container are concentric about a longitudinal axis and a distance between the longitudinal axis and a diameter of peaks of the external threads of the container is less than a distance between the longitudinal axis and a diameter of peaks of the internal threads of the capsule.

* * * * *